US007048464B2

(12) United States Patent
Ronnquist

(10) Patent No.: US 7,048,464 B2
(45) Date of Patent: May 23, 2006

(54) CONNECTION DEVICE, BOX AND CLAMP

(75) Inventor: Lennart Ronnquist, Skultuna (SE)

(73) Assignee: Foldy Pac Supply BV, AdWaalwijk (NL)

( * ) Notice: Subject to any disclaimer, the term of this patent is extended or adjusted under 35 U.S.C. 154(b) by 0 days.

(21) Appl. No.: 10/239,289

(22) PCT Filed: Mar. 15, 2001

(86) PCT No.: PCT/SE01/00537

§ 371 (c)(1),
(2), (4) Date: Feb. 3, 2003

(87) PCT Pub. No.: WO01/70588

PCT Pub. Date: Sep. 27, 2001

(65) Prior Publication Data

US 2003/0147690 A1 Aug. 7, 2003

(30) Foreign Application Priority Data

Mar. 20, 2000 (SE) ..... 0001035

(51) Int. Cl.
*B25G 3/36* (2006.01)
*E05C 19/06* (2006.01)
*B65D 45/16* (2006.01)

(52) U.S. Cl. ..... 403/321; 403/325; 403/326; 403/329; 403/397; 292/80; 292/87; 292/253; 220/326

(58) Field of Classification Search ..... 403/110, 403/247, 256, 321, 325, 326, 329, 397; 24/545, 24/546; 292/80 X, 81, 87, 253, DIG. 61, 292/80; 220/326 X, 833, 326
See application file for complete search history.

(56) References Cited

U.S. PATENT DOCUMENTS 898,800 A * 9/1908 Stokely ..... 292/253
1,494,114 A * 5/1924 Ike ..... 292/253
1,698,574 A * 1/1929 Winchell ..... 292/253
1,931,216 A * 10/1933 Zell ..... 220/326
3,858,370 A * 1/1975 Halstead ..... 403/397
4,270,668 A * 6/1981 Berfield ..... 292/87
5,363,150 A * 11/1994 Kojima ..... 348/836
6,378,918 B1 * 4/2002 Mita et al. ..... 292/87

FOREIGN PATENT DOCUMENTS

EP 0209086 1/1987
SE 509910 3/1999

* cited by examiner

*Primary Examiner*—Daniel P. Stodola
*Assistant Examiner*—Victor MacArthur
(74) *Attorney, Agent, or Firm*—Howard & Howard

(57) ABSTRACT

One first aspect of the invention relates to a connection device for the bottom (1) and lid (3) of a box with side-panels (2). The device comprises one or more first attachment means (5) firmly connected to the bottom (1) and lid (3) and one or more attachment means (6) firmly connected to at least one side panel (2). Connection means (7) are also provided for connecting the bottom (1) and lid (3) to the side panel (2) ny interaction with the attachment means (5, 6). Each connection means (7) consists of a clamp with a resilient body (7.1), a first hook (7.2) being arranged at one end and a second hook (7.3) being arranged at the other end. The first attachment means consists of a first rail (5), arranged along an edge on the bottom (1) and lid (3) respectively, equipped with connection means consisting of one or more slots (5.4). The second attachment means consists of a second rail (6) arranged on a side panel (2) essentially parallel to the edge of the side panel (2). The first hook (7.2) is devised to hook into a slot (5.4) in the first rail (5). According to the invention, the clamp is equipped with a third hook (7.7). The first rail's (5) connection means also has receptor means (5.5) for the third hook (7.7). The receptor means (5.5) is arranged to receive the third hook (7.7) in a reception direction differing from the application direction of the first hook (7.2) into the slot (5.4). This prevents the clamp (7) from falling off the first rail (5). The invention also relates to a box equipped with this connection device and a clamp (7) intended for use in such a connection device.

20 Claims, 2 Drawing Sheets

FIG - 1
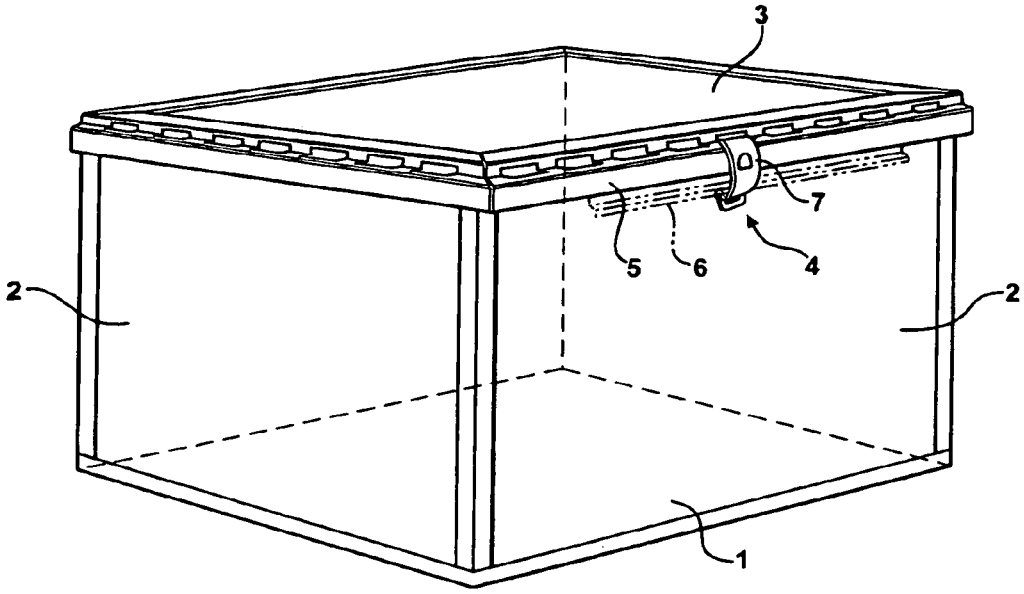
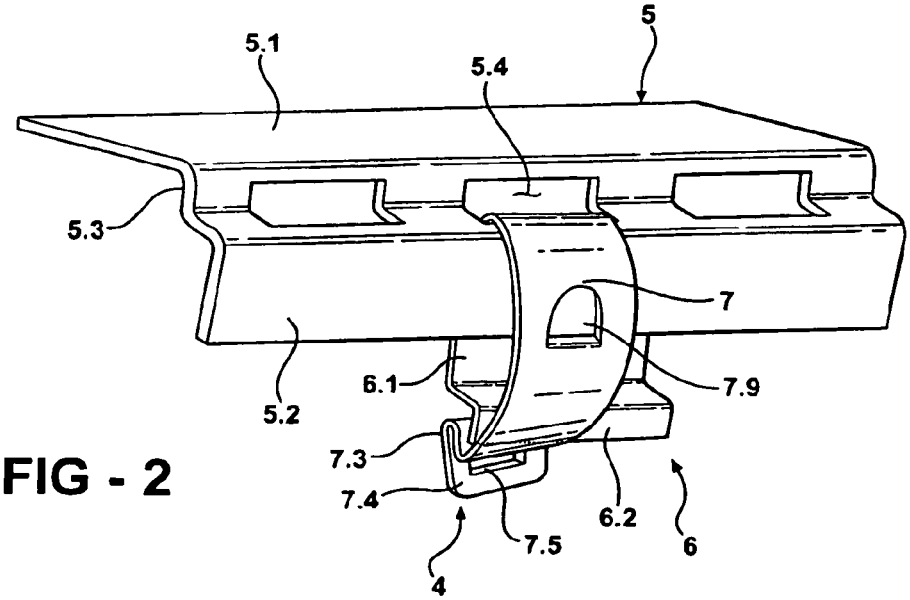
FIG - 2

CONNECTION DEVICE, BOX AND CLAMP

FIELD OF INVENTION

A first aspect of the present invention relates to a connection device for the bottom and lid of a box with side panels It comprises one or more attachment means firmly attached to the lid, one or more other attachment means firmly attached to at least one side panel and connection means for connecting the lid to the side panel by engaging the attachment means. The bottom, side panels and lid are preferably made of a panel material such as plywood. A second aspect of the invention relates to a box provided with a connection device according to the invention. A third aspect of the invention relates to a clamp devised to serve as a component in the invented connection device.

DESCRIPTION OF PRIOR ART

The Swedish patent document SE-C442 823 teaches one way to fabricate a box and a device for fixed but detachable connection of an edge section of a first part of the box to and an adjacent edge section of a second part of the box.

The Swedish patent documents SE-A-85 04 578-9 and SE-A-85 04 600-1 describe similar devices for detachable connection of box parts. Similar devices are also taught in WO 91/15 404, EP 209 086, FR 1 228 951 and NO 23 235.

These known devices have certain shortcomings. These shortcomings have been largely overcome with a connection device described in SE 509 910. Thus, the document describes a connection device for a bottom and a lid of a box with side panels. It comprises a first attachment means firmly attached to the bottom and lid respectively, a second attachment means firmly attached to at least one side panel and a connection means for connecting the bottom and lid to the side panel. The respective connection means consists of a resilient clamp on whose ends a first hook and a second hook are arranged. The first attachment means consists of a first rail arranged along an edge on the bottom and the lid respectively. The second attachment means consists of a second rail arranged on a side panel, essentially parallel to the edge of same. The first hook is arranged for hooking into a slot in the first rail which has a plurality of slots along its length. Even if the device according to the latter document represents a major advance compared to previously known devices, there is still room for improvement. The device has been found to have the disadvantage in that the clamps can fall off the lid after it has been removed from the rest of the box. The clamps can also fall off and be lost, especially when the lid is removed and turned upside down.

SUMMARY OF THE INVENTION

The objective of a first aspect of the present invention is to achieve a connection device for the bottom and lid of a box with side panels for which the aforementioned shortcoming of previously known devices has been overcome.

This objective has been achieved when a connection device of the kind cited in the preamble to claim 1 has the special features cited in the claim's characterising clause.

Thus, the connection device comprises a clamp with a third hook, and the first attachment means contains receptor means for the third hook. Since the receptor means are devised to accommodate the third hook in a reception direction differing from the first hook's direction of application into the slot, the clamp cannot fall off the first attachment means. Since the lid is turned in the right direction, i.e. oriented in the same way as when it is attached to the box, the first hook's engagement in the slot keeps the clamp from falling off if the lid is turned upside-down, the third hook's attachment to the receptor means keeps the clamp from falling off. In intermediate positions, the first and third hooks prevent this to varying degrees. The two hooks therefore jointly constitute a locking device which keeps the clamp attached to the lid so there is no risk of it being lost, and it is available the next time the box is to be closed.

This locking is most effective when the reception direction is essentially the same as the application direction. This is therefore a preferred embodiment of the invention.

According to an additional preferred embodiment of the invention, the third hook is resiliently connected to the body of the clamp. This makes possible attachment of the clamp to the first attachment means when the first hook is applied. The third hook is then bulges outwards, overcoming the spring force, enabling it to be received by the first attachment means' receptor means and then snap into it when pressure on the third hook is relaxed.

According to a preferred embodiment of the invention, the third hook is achieved by punching it out of the body of the clamp so it is connected to the body along a bending line and forms an angle with the body. This design has a number of advantages. Firstly, it is a very simple way of fabricating the third hook. Moreover, a spring function is achieved in a simple fashion as a result of the bending line's spring effect. Moreover, the punched-out body is weakened, thereby making it easier to flatten when the second hook is to be attached to the second attachment means.

The third hook is suitably arranged relatively close to the first hook in order to facilitate their interaction as locking units. This is accordingly an additional preferred embodiment of the invention.

The aforementioned and other embodiments of the invented connection device are set forth in the dependent claims of claim 1.

The objective for a second aspect of the invention is achieved when a box, as set forth in claim 8, is equipped with a connection device according to the invention. This conveys advantages of the corresponding kind outlined above.

The objective for a third aspect of the invention is achieved when a clamp of the kind set forth in the preamble to claim 8 displays the special features set forth in the characterising clause of this claim. The invented clamp is a vital component in the invented connection device.

Advantageous embodiments of the invented clamp are set forth in the dependent claims of claim 9. The invented clamp and the preferred embodiments of same convey advantages of the corresponding kind set forth above for the invented connection device.

The invention will be explained in greater detail in the following description of preferred embodiments of same, referring to the attached drawings.

BRIEF DESCRIPTION OF THE FIGURES

FIG. 1 is a perspective view of a box equipped with a connection device, according to a first embodiment of the invention, for attaching a lid to the box.

FIG. 2 is an enlarged section of the connection device on the box according to FIG. 1.

DESCRIPTION OF THE EMBODIMENTS

Figure 3:
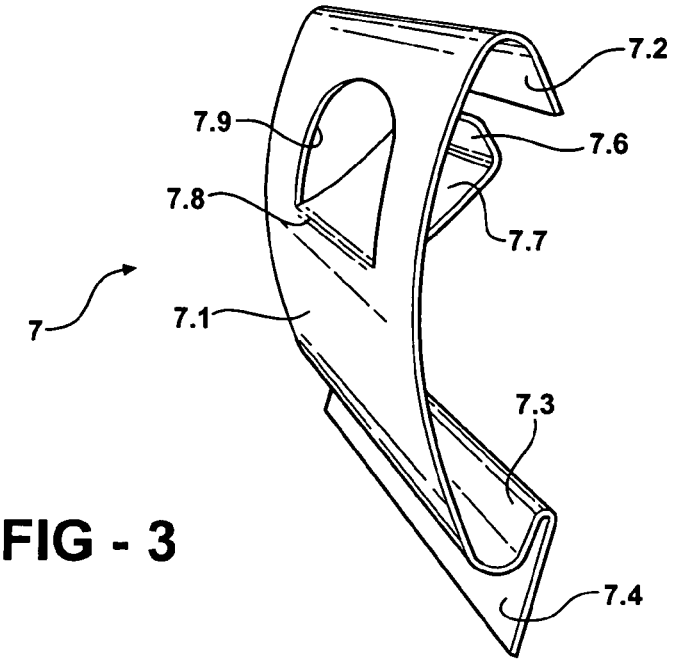
FIG. 3 is a perspective view of a resilient clamp in the connection device in FIG. 4.

The box shown in FIG. 1 has a bottom 1, four side panels 2 and a lid 3. The bottom 1, side panels 2 and lid 3 are all preferably made of plywood. The lid 3 is resiliently connected to two opposite side panels 2 with connection devices 4 according to the invention. The box shown in FIG. 1 is equipped with two complete connection devices 4 on opposite sides of the box. The bottom 1 in the FIG. is only shown schematically connected to the side panels 2.

The connection device 4 according to the invention includes at least one first attachment means 5, which includes a first rail 5, firmly attached to two or more of the edges of the lid 3. At least one second attachment means 6, which includes a second rail 6, is firmly arranged along two or more upper edges of the side panels 2, and at least one connection means 7, connecting the first rail 5 to the second rail 6, is provided. The first rail 5 has a largely L-shaped cross-section. Its first flange 5.1 is firmly attached to the lid 3 and arranged on the same plane through the upper, flat surface of the lid 3. Its second flange 5.2 is on a plane parallel to and at a distance from a plane through the outer flat surface of the corresponding side panel 2. The second flange 5.2 also has a section 5.3 right next to a first flange 5.1 on the same plane as the plane through the outer surface of the side panel 2 and which, when the lid 3 is placed on the box, extends down along the edge of the lid 3. The second rail 6 has an essentially Z-shaped cross-section. One of its flanges 6.1 is firmly connected to the side panel 2 and located closest to the first rail 5. Its second flange 6.2 can freely extend down towards the bottom 1 of the box.

The first rail 5 advantageously extends along the entire edges of the lid 3 and, preferably, along all four corners of the lid 3. The first rail 5 also has connection means or slots 5.4 along its entire length. One or more connection means 7 can be attached thereto for connecting the lid 3 to each side panel 2. The second rail 6 advantageously runs parallel to the entire first rail 5, permitting interaction with the first rail 5 by means of one or more connection means 7 arranged on at least two opposite sides of the box.

In an alternative version of the connection device 4 according to the invention, the first rail 5 and the second rail 6 can be arranged around all four sides of the box and be connected to one or more connection devices 4 on each side.

When the lid 3 is jarred or jolted, e.g. when struck by the forks of a fork-lift truck, the resilient connection means 7 ensure that the lid 3 is able to move both up and to the side in relation to the side panels 2 and then return to its original position. In this position, the connection means 7 exert a spring force which keeps the lid 3 pressed against the side panels 2 of the box. Lateral movements are accommodated by a gap arranged between the exterior of the side panel 2 and the downward pointing flange 5.2 of the first rail 5.

The connection device 4 according to the invention can also be used on a box with a lid 3 with an articulated connection to a side panel 2 by means of a conventional hinge. In this version, the lid 3 does not have the same freedom of movement as when it is attached to the side panels 2 by the device's connection means 7. However, unimpeded resilience can be allowed in stances in which the hinge itself is spring-mounted and has the same design, in principle, as the connection means 7 according to the invention, i.e. a strap-shaped body whose ends have an articulated connection to the bottom 1 and lid 2 of the box.

Replacing the rails 5, 6 in the connection device 4 with attachment means with other appearances or which wholly or partially extend along the edges of the box is also within the scope of the invention. These means can also be arranged at optional positions on the bottom 1, side panels 2 or lid 3. The connection means 7 can also consist of multiple parts, at least one of which being resilient and allowing the bottom 1 and lid 3 to move in relation to the side panels 2.

A modified version of the connection means 7, which includes a resilient material such as a band of spring steel, is shown separately in FIG. 3 and is devised as a clamp with a concave, segmented resilient body 7.1 bulging away from the box. One end of this means has a first hook 7.2, and the other end has a second hook 7.3. The first hook 7.2 is devised to hook into a slot 5.4 on the first rail 5 on the lid 3. The second hook 7.3 is devised to snap onto the free second flange 6.2 on the second rail 6 on the side panel 2. The second hook 7.3 is equipped with a protruding lip 7.4 to facilitate detachment and removal of the connection means 7.

An area has been punched out of the connection means 7 and bent along a bending line 7.8. The punched out section forms a third hook 7.7 with an angled end 7.6. The punching operation forms an opening 7.9 in the body of the connection means 7.

The connection means in FIG. 3 has been modified compared to the connection means 7 shown in FIGS. 1 and 2 so the punched-out opening 7.9 in the former is closer to the first hook 7.2 than in the version according to FIGS. 1 and 2. This version also lacks an opening 7.5 in the lip 7.4 shown in the version according to FIGS. 1 and 2. Such an opening 7.5 can also be added to the lip 7.4 even in the version according to FIG. 3. A screwdriver or similar tool can be inserted into the opening 7.5 to detach the clamp from the side edge by pressing the screwdriver tip against the body 7.1 which is accordingly flattened and elongated, causing the hook 7.3 to release its grip on the second rail 6.

Figure 4:
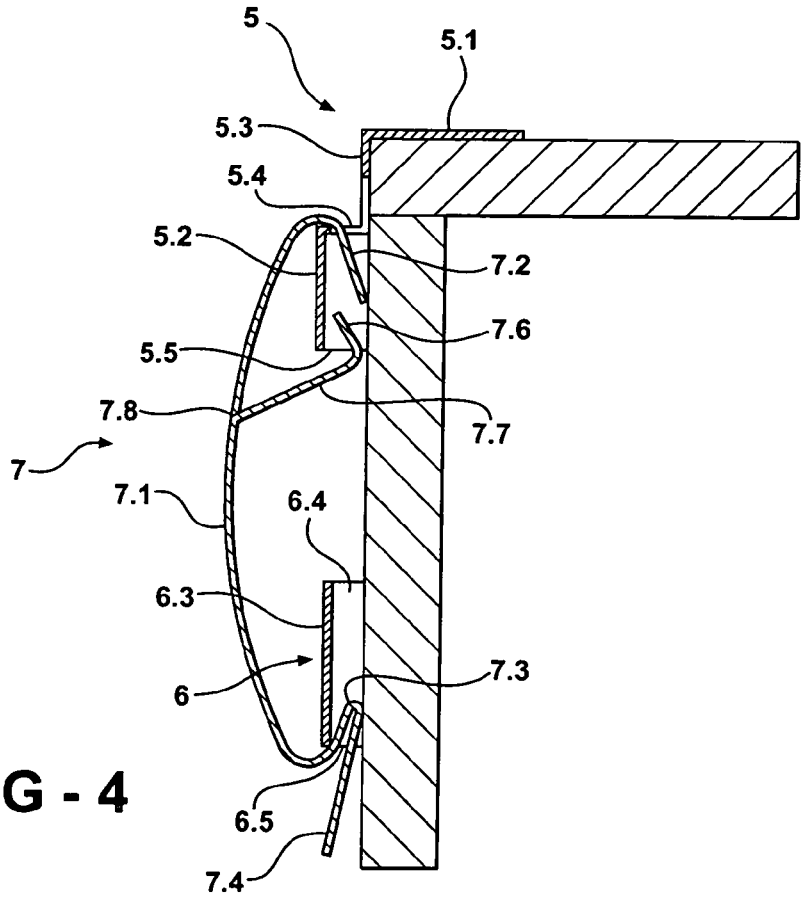
FIG. 4 is an enlarged cross-section through the connection device on a box, similar to the one in FIG. 1, according to a second embodiment.

FIG. 4 shows in detail how a connection means 7, which includes a clamp according to the inventions interacts with the two attachment means or rails 5 and 6. The clamp 7 is the same clamp shown in FIG. 3. The attachment means or rail 5 on the lid is the same kind as the one shown in FIGS. 1 and 2. The attachment means or rail 6 on the side panel 3 is somewhat modified compared to the version shown in FIGS. 1 and 2. In the version according to FIG. 4, the attachment means includes a strip 6.3 extending along edges of the box's side panel, i.e. perpendicular to the plane of the FIG. The strip 6.3 is separated from the external side of the side panel 2 by stays 6.4 which can be arranged with one at either end of the strip 6.3 and possibly a few in between. The strip 6.3 accordingly forms a gap between itself and the side panel 2. This gap is open, at least at the bottom, through the oblong opening 6.5.

When the lid 3 is attached to a side panel 2, the first hook 7.2 on the clamp 7 is first hooked into a slot 5.4 on the first rail 5. The third hook 7.7 is then bent down so it slips in under the rail's 5 second flange 5.2. The flexural force on the third hook 7.7 is then relieved so its angled end 7.6 or outer tip rebounds up into an opening 5.5 at the base of the rail 5. This opening 5.5 is accordingly the receptor means 5.5 for the third book 7.7. The body 7.1 of the clamp is then pressed against the side panel 2. This forces its lower end down far enough to allow the upper edge of the second hook 7.3 to descend below the strip 6.3. When the pressure exerted on the body 7.1 of the clamp is then relieved, the second hook 7.3 slips in behind the strip 6.3, thereby attaching the lid 3 to the side panel 2. The reverse procedure is followed when the clamp 7 is detached from the attachment means 6. The clamp 7 detached from the attachment means 6 can advantageously be left attached to the lid's attachment means 5, as there is no risk of it falling off, as noted above. When a box, with the clamp 7 still attached to the lid 3, is re-closed, the initial steps described above in this paragraph are naturally eliminated.

The attachment means 6 shown in FIG. 4 can naturally be devised in the same way as in the example shown in FIGS. 1 and 2.

The invention claimed is:

1. A connection device, for connecting at least one of a bottom (1) and a lid (3) to a box with side panels (2), comprising:

at least one first attachment means (5) adapted to be firmly connected to at least one of the bottom (1) and lid (3), the first attachment means including a first rail (5) having a connection means comprising one or more slots (5.4);

at least one second attachment means (6) adapted to be firmly connected to at least one side panel (2), the second attachment means including a second rail (6); and a connection means (7) for connecting at least one of the bottom (1) and lid (3) to the side panel (2) by interaction with the first and second attachment means (5, 6), the connection means (7) including a clamp with a resilient body (7.1) spaced from said attachment means (5, 6), a first hook (7.2) being arranged on one end thereof and a second hook (7.3) being arranged at the other end, whereby the first hook (7.2) is moved along an application direction to hook into the slot (5.4) in the first rail (5) to secure the clamp within the first rail (5) in the application direction;

the connection device characterized in that the clamp is equipped with a third hook (7.7), and the first attachment means (5) also comprises receptor means (5.5) for the third hook (7.7), the receptor means (5.5) being arranged to accommodate the third hook (7.7) in a reception direction differing from the application direction of the first hook (7.2) into the slot (5.4) with each of the first and third (7.2, 7.7) hooks having a distal end and the distal ends facing each other to secure the clamp about a portion of the first rail (5) for preventing the clamp (7) from falling off the first rail (5).

2. A connection device according to claim 1, characterized in that the reception direction is essentially in opposition to the application direction.

3. A connection device according to claim 1, characterized in that the third hook (7.7) is resiliently connected to the body (7.1) of the clamp (7).

4. A connection device according to claim 3, characterized in that the third hook (7.7) is punched out of the body (7.1) of the clamp (7) and connected to the body (7.1) along a bending line (7.8), and the third hook (7.7) is at an angle with the body (7.1).

5. A connection device according to claim 1, characterized in that the third hook (7.7) is arranged close to the first hook (7.2).

6. A connection device according to claim 1, characterized in that the second hook (7.3) is arranged for lateral movement for force-transmitting interaction with the second attachment means (6), thereby enabling at least one of the bottom (1) and the lid (3) to move upward and to the side in relation to the side panels (2) when the box is subjected to jarring or jolting.

7. A connection device according to claim 1, characterized in that the width of the respective slot (5.4) is slightly greater than the width of the first hook (7.2).

8. A connection device according to claim 1, characterized in that the second hook (7.3) has a distal end facing the distal end of the first hook (7.2).

9. A connection device according to claim 8, characterized in that the second and third hooks (7.3, 7.7) are both arranged to move along the reception direction.

10. A connection device according to claim 1, characterized in that the resilient body (7.1) is arcuate between the first and second hooks (7.2, 7.3).

11. A box assembly comprising:

a bottom (1) and a lid (3);

side panels (2) disposed between the bottom (1) and lid (3); and a connection device connecting at least one of the bottom (1) and lid (3) to at least one side panel, the connection device comprising:

at least one first attachment means (5) firmly connected to at least one of the bottom (1) and lid (3), the first attachment means including a first rail (5) having a connection means comprising one or more slots (5.4);

at least one second attachment means (6) firmly connected to at least one side panel (2), the second attachment means including a second rail (6); and a connection means (7) for connecting at least one of the bottom (1) and lid (3) to the side panel (2) by interaction with the first and second attachment means (5, 6), the connection means (7) including a clamp with a resilient body (7.1) spaced from said attachment means (5, 6), a first hook (7.2) being arranged on one end thereof and a second hook (7.3) being arranged at the other end, whereby the first hook (7.2) is moved along an application direction to hook into the slot (5.4) in the first rail (5) to secure the clamp within the first rail (5) in the application direction;

the connection device characterized in that the clamp is equipped with a third hook (7.7), and the first attachment means (5) also comprises receptor means (5.5) for the third hook (7.7), the receptor means (5.5) being arranged to accommodate the third hook (7.7) in a reception direction differing from the application direction of the first hook (7.2) into the slot (5.4) with each of the first and third (7.2, 7.7) hooks having a distal end and the distal ends facing each other to secure the clamp about a portion of the first rail (5) for preventing the clamp (7) from falling off the first rail (5).

12. A box assembly according to claim 11, characterized in that the reception direction is essentially in opposition to the application direction.

13. A box assembly according to claim 11, characterized in that the third hook (7.7) is resiliently connected to the body (7.1) of the clamp (7).

14. A box assembly according to claim 13, characterized in that the third hook (7.7) is punched out of the body (7.1) of the clamp (7) and connected to the body (7.1) along a bending line (7.8), and the third hook (7.7) is at an angle with the body (7.1).

15. A box assembly according to claim 11, characterized in that the third hook (7.7) is arranged close to the first hook (7.2).

16. A box assembly according to claim 11, characterized in that the second hook (7.3) is arranged for lateral movement for force-transmitting interaction with the second attachment means (6), thereby enabling at least one of the bottom (1) and the lid (3) to move upward and to the side in relation to the side panels (2) when the box is subjected to jarring or jolting.

17. A box assembly according to claim 11, characterized in that the width of the respective slot (5.4) is slightly greater than the width of the first hook (7.2).

18. A box assembly according to claim 11, characterized in that the second hook (7.3) has a distal end facing the distal end of the first hook (7.2).

19. A box assembly according to claim 18, characterized in that the second and third hooks (7.3, 7.7) are both arranged to move along the reception direction.

20. A box assembly according to claim 11, characterized in that the resilient body (7.1) is arcuate between the first and second hooks (7.2, 7.3) and is continuously spaced from the bottom (1) and the lid (3).

* * * * *